United States Patent [19]

Miles et al.

[11] Patent Number: 4,493,586

[45] Date of Patent: Jan. 15, 1985

[54] RIP-RAP LAYING MACHINE AND METHOD OF LAYING RIP-RAP

[75] Inventors: Lee W. Miles, Corinth, Miss.; Samuel W. Chambers, Boise; Mathias F. Rice, Cascade, both of Id.

[73] Assignee: Morrison-Knudsen Co., Inc., Boise, Id.

[21] Appl. No.: 348,781

[22] Filed: Feb. 16, 1982

[51] Int. Cl.[3] ..... E02B 3/12

[52] U.S. Cl. ..... 405/17; 405/15; 405/16

[58] Field of Search ..... 405/15–19, 405/268; 404/101, 96, 108

[56] References Cited

U.S. PATENT DOCUMENTS

| | | | |
|---|---|---|---|
| 2,090,959 | 8/1937 | Jackson | 405/268 |
| 2,094,974 | 10/1937 | Wood | 405/268 |
| 3,342,035 | 9/1967 | Sale | 404/108 X |
| 4,360,293 | 11/1982 | Wade | 405/268 |

FOREIGN PATENT DOCUMENTS

| | | | |
|---|---|---|---|
| 1203210 | 7/1959 | France | 405/268 |
| 715695 | 2/1980 | U.S.S.R. | 405/268 |

*Primary Examiner*—Dennis L. Taylor

*Attorney, Agent, or Firm*—Seed and Berry

[57] ABSTRACT

A rip-rap laying machine designed to lay approximately 270 tons of rip-rap per hour resembles a huge steel bridge frame. The self-propelled unit overlies an acutely angled bank of a waterway, channel, or canal and moves along the bank (40) to lay rip-rap uniformly. The machine uses two cable-controlled hoppers (34 and 36) mounted on rails (20 and 22). An operator rides with the feeder hopper (36) and controls a loading hopper (34) to run between a dump hopper (32) on one end of the bridge and the feeder hopper (36). The loading hopper (34) transfers rip-rap from a dump hopper (32) to the feeder hopper (36). The rip-rap is transferred from the feeder hopper (36) to a vibratory feeder (38), which vibrates the rip-rap onto deflector plate (44) before rolling gently onto sheets of filter cloth placed upon the bank (40). Uniform placement of the rip-rap on the bank (40) occurs as the vibratory feeder (38) travels from the bottom to the top of the bridge. The machine is propelled on four independently powered crawler tracks (46). With tracks (46) of this type, the rip-rap laying machine can be moved at a rate of about twenty-two feet per minute along the acutely angled bank (40). A method of laying rip-rap using a rip-rap laying machine according to this invention is also described.

20 Claims, 16 Drawing Figures

FIG. 9
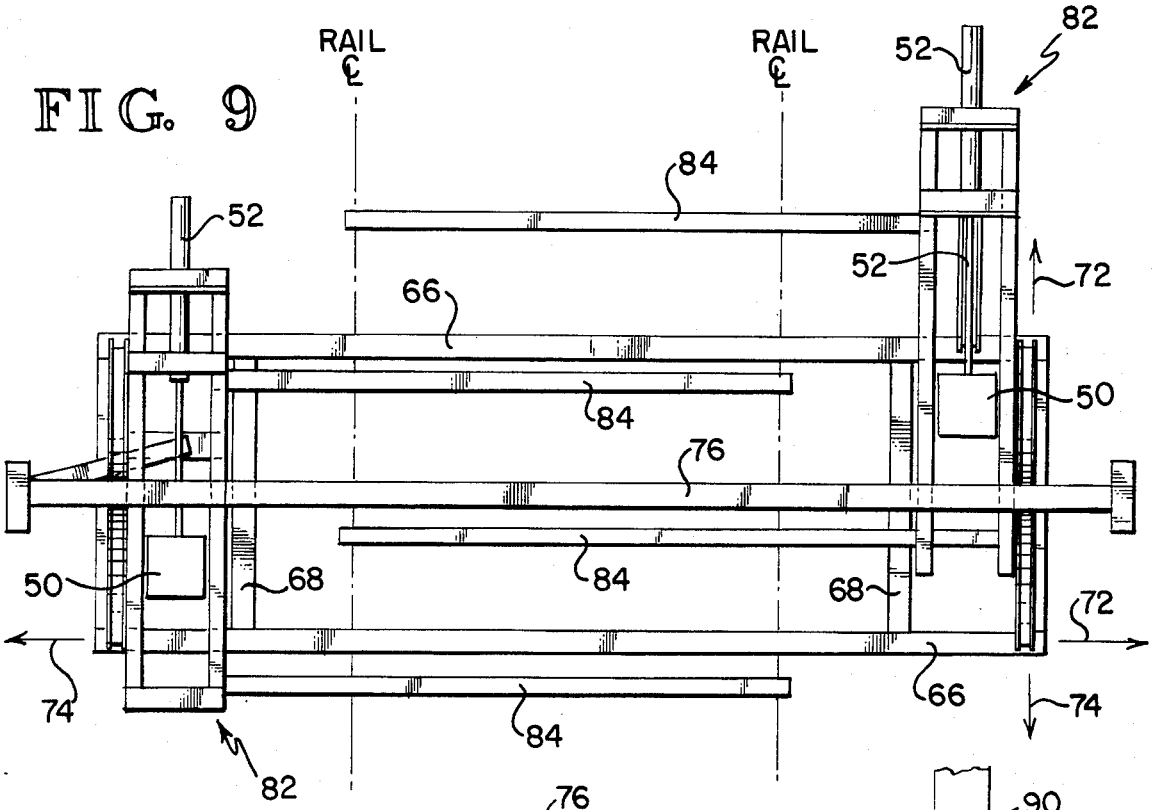
FIG. 10C
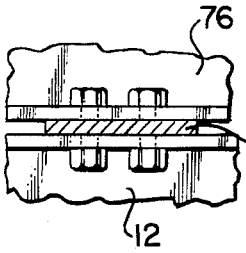
FIG. 10B
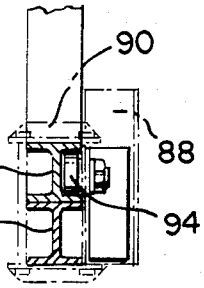
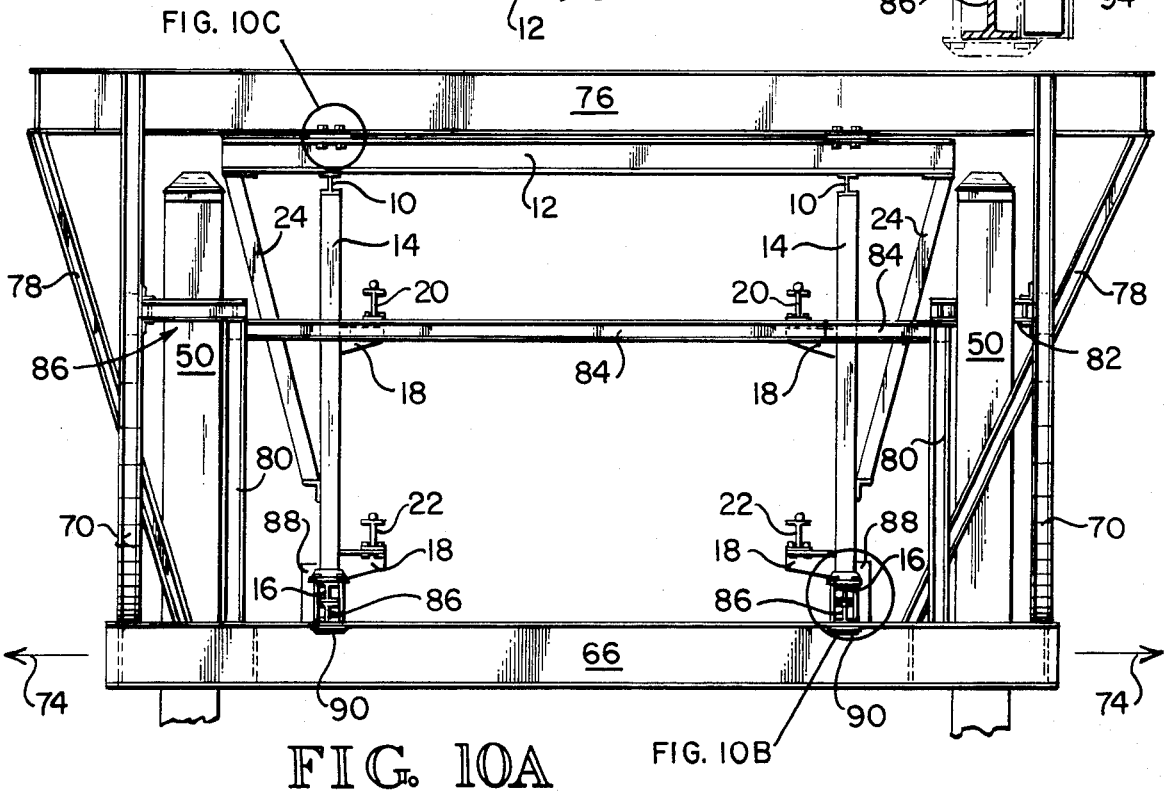
FIG. 10A

RIP-RAP LAYING MACHINE AND METHOD OF LAYING RIP-RAP

DESCRIPTION

1. Technical Field

The present invention relates to a rip-rap laying machine and to a method of laying rip-rap. More particularly, the invention relates to a rip-rap laying machine which is capable of distributing rip-rap onto an acutely angled bank using a bridge section overlying the bank. A hopper receives rip-rap near one end of the bridge and fills a traveling loading hopper which, in turn, fills a feeder hopper which distributes the rip-rap along the bank.

2. Background Art

Ordinarily, to lay rip-rap along a bank of a waterway, it is necessary to move the rock to the bank with cranes or to dress the slope with tractors after rip-rap is laid. Either method is time-consuming and expensive. It is important that as little labor as possible be expended grooming the rip-rap slope if the costs are to be kept in check.

Related equipment for extensive construction projects are sometimes used. For example, there are the R. A. Hanson Company, Inc., excavator and the Strabag Bau Ag paving rig (used at the Luddington, Mich., pump storage project). Unsuitable as rip-rap laying machines, these devices, however, indicate the value of special designs for special projects.

DISCLOSURE OF INVENTION

A rip-rap laying machine is capable of distributing rip-rap onto an acutely angled bank without the assistance of cranes or tractors to dress the slopes. The rip-rap laying machine resembles a huge steel bridge frame which spans the dimension of the bank. The bridge is self-propelled on two sets of crawler tracks. Approximately 145 feet long, the rip-rap laying machine can easily span the 90-to 120-foot lengths required to lay rip-rap for most reservoir or canal projects. The rip-rap laying machine is able to place a blanket of rock on slopes of various angles. When the rip-rap machine is operating, a front end loader working at the toe end of the bridge will supply rip-rap to a dump hopper on the bridge, which will, in turn, transfer the rip-rap to a loading hopper. The loading hopper moves along the bridge along an upper pair of rails to transfer the rip-rap to a rip-rap laying means. The rip-rap laying means includes a feeder hopper which moves along the bridge along a lower pair of rails and a vibratory feeder, disposed beneath the feeder hopper to receive rip-rap from the feeder hopper and to distribute the rip-rap in a uniform blanket on the bank. The machine can cover a seven-foot width with each pass and has a design production rate of approximately 270 tons of rip-rap per hour.

The effective length of the rip-rap laying machine is adjustable by means of a slide frame which carries one of the sets of independently powered crawler tracks. The slide frame has a generally rectangular base whose length exceeds the width of the bridge. Two slide frame tracks are carried on the base with pivotable and extensible slide-frame masts associated with each track. The slide-frame masts allow raising and lowering of the base and pivoting of the base relative to the tracks. Preferably, the masts are carried on opposite corners of the base and on opposite sides of the bridge.

Similarly, the set of tracks on lower end of the bridge adjacent the dump hopper are preferably extensible and pivotable. Thus, the rip-rap laying machine may assume a plurality of angles relative to the bank, and may assume a plurality of heights above the bank. The ability to adjust the positioning of the rip-rap laying machine relative to the bank makes the rip-rap laying machine much more versatile.

To lay rip-rap along an acutely angled bank, the bridge of the rip-rap laying machine is placed across the bank, rip-rap is loaded into a dump hopper near one end of the bridge, the rip-rap is transferred to a loading hopper which conveys the rip-rap along the bridge to a rip-rap laying means and, thereafter, the rip-rap is distributed along the bank. The rip-rap is distributed along the bank as the rip-rap laying means moves upwardly along the length of the bridge. While rip-rap is being distributed, the rip-rap laying means may be replenished with additional rip-rap supplied by the loading hopper. A deflector plate below the vibratory feeder of the rip-rap laying means allows smoother and more uniform distribution of rip-rap. The deflector plate may assume a plurality of angles relative to the bridge, thereby varying the distribution effect of falling rip-rap. The deflector plate also cushions the impact of rip-rap with the bank to protect coverings laid on the bank (which check loss of fines from the soil and which reduce growth of weeds along the bank).

BRIEF DESCRIPTION OF THE DRAWINGS

FIG. 9 is a top plan view of a preferred slide frame.

FIG. 10A is a side elevational view of the slide frame of FIG. 9 encircling the bridge section of the rip-rap laying machine.

FIG. 10B is a detailed view of a support structure for clamping the slide frame to the bridge section.

FIG. 10C is a detailed view of the shim plates between the slide frame and bridge.

BEST MODE FOR CARRYING OUT THE INVENTION

I. The Rip-Rap Laying Machine Structure

Figures 2, 3:
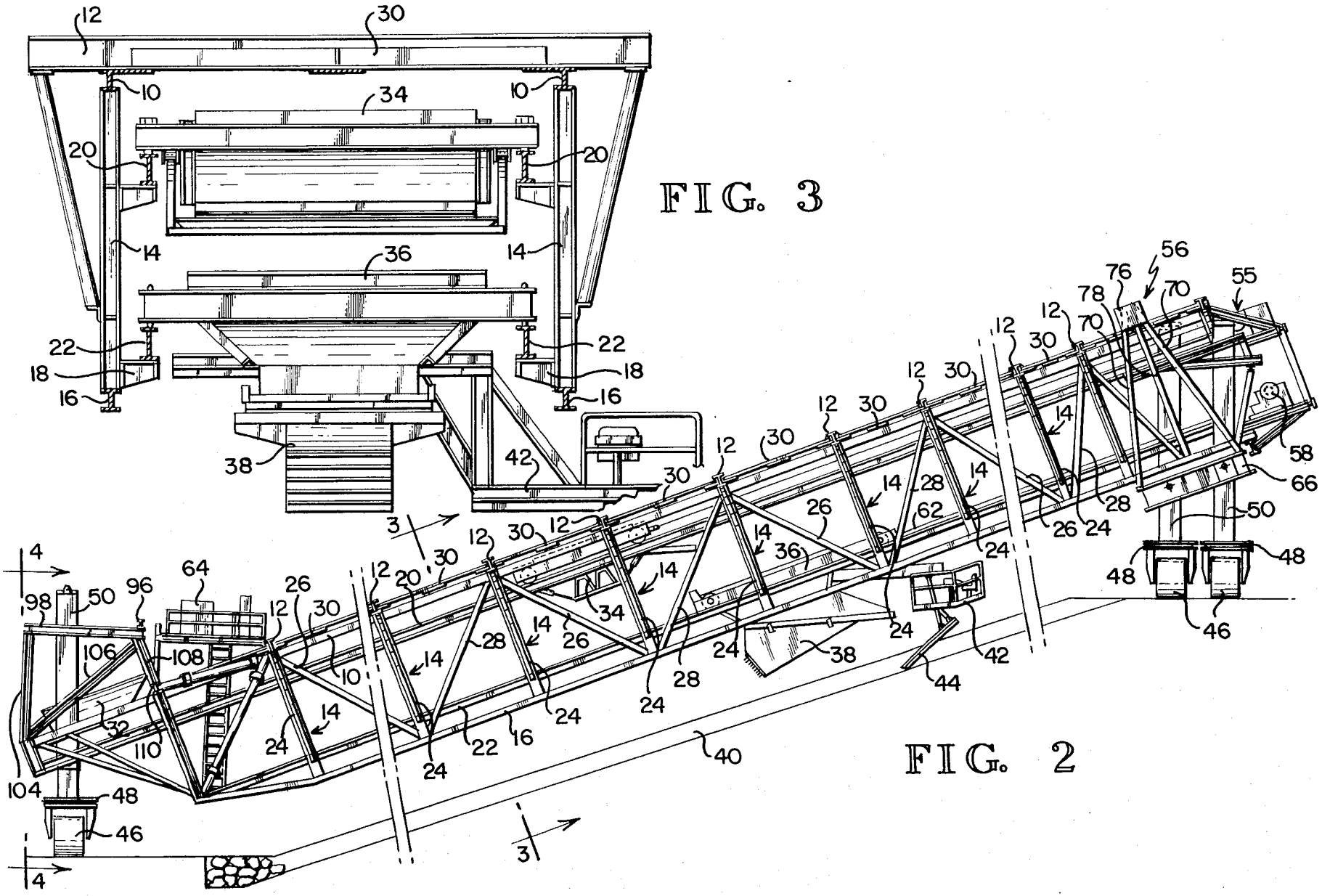
FIG. 2 is a side elevational view of the rip-rap laying machine of FIG. 1.
FIG. 3 is a sectional view taken along line 3—3 of FIG. 2.

The bridge of the rip-rap machine defines the main structure of the machine. As a backbone for the bridge, a pair of beams 10 extend substantially parallel to the each other to define the length for the bridge. A plurality of spaced, substantially parallel struts 12 extend transversely across the beams 10 and are secured to the beams 10 to define the width of the bridge. A plurality of supports 14 extend downwardly from the struts 12, one support 14 attached near each end of each strut 12. The supports 14 define the depth of the bridge section and a width suitable to accommodate the rail system of the machine, which is mounted within the bridge and which is used to distribute rip-rap. A lower pair of beams 16 are secured to the bottom of the supports 14 on each side of the bridge and extend substantially the entire length of the bridge substantially parallel to the upper pair of beams 10. Support struts 18 (see FIG. 3) are secured to the intermediate and lower inside of supports 14 to support upper and lower pairs of parallel rails 20 and 22, respectively. Angled reinforcing members 24 extend between each support 14 and each associated strut 12 outside the width of the rail systems to further strengthen the bridge. Cross-members 26 and 28 which extend respectively between the upper and lower beams 20 and 22 aid in reinforcing the frame. Finally, pairs of strut-reinforcing girders 30 cross between adjacent pairs of struts 12, extend between the supports 14 in a plane substantially parallel to the plane defined by the upper pair of beams 10, and are located immediately above the upper pair of beams. In some circumstances, other bridges may be used, so long as the bridge is a strong U-truss opening downwardly.

A dump hopper 32 is secured to the bridge near one end to receive rip-rap. (For purposes of this description, "rip-rap" means conventional rip-rap and other rock which might be placed on a bank. The machine can be designed to transfer nearly any size rock. Therefore, "rip-rap" should not be interpreted as a size limitation.) The dump hopper 32 transfers rip-rap to a four-wheeled loading hopper 34 which moves along the bridge along the upper pair of rails 20 to transport the rip-rap from the dump hopper 32 to a rip-rap laying means which, in turn, moves along the bridge on the lower pair of rails 22. The rip-rap laying means includes a four-wheeled feeder hopper 36 which receives rip-rap from the loading hopper and which transfers the rip-rap to a vibratory feeder 38. The vibratory feeder 38 distributes the rip-rap onto the bank 40. Preferably, a cantilevered control platform 42 is connected to the frame of the feeder hopper 36 to enable an operator to direct the smooth, efficient, and uniform distribution of rip-rap onto the bank 40.

Winches 55 and 58 move the loading hopper 34 and feeder hopper 36, respectively, along the rail systems with associated cables 60 and 62 that are connected to each hopper 34 and 36.

Figure 13:
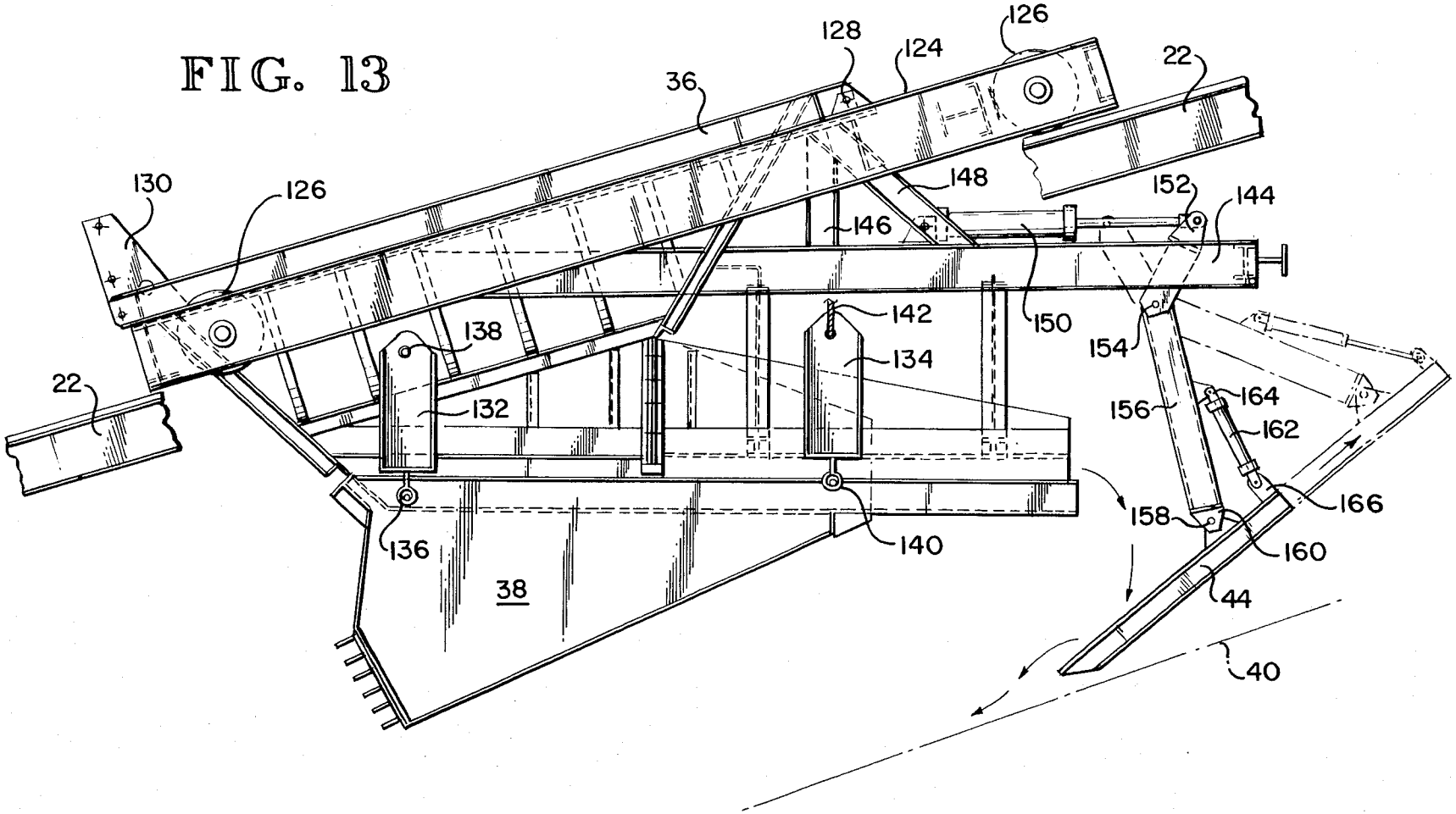
FIG. 13 is a detailed view of a preferred vibratory feeder.

To ensure uniform distribution of rip-rap onto the bank without damaging the bank 40 or any covering on the bank 40, a deflector plate 44 is operatively associated with the vibratory feeder 38 to deflect the rip-rap exiting from the vibratory feeder 38 and to cushion and to distribute this falling rip-rap onto the bank 40. The details of the deflector plate 44 are best shown in FIG. 13, and will be described in greater detail later.

Figure 1:
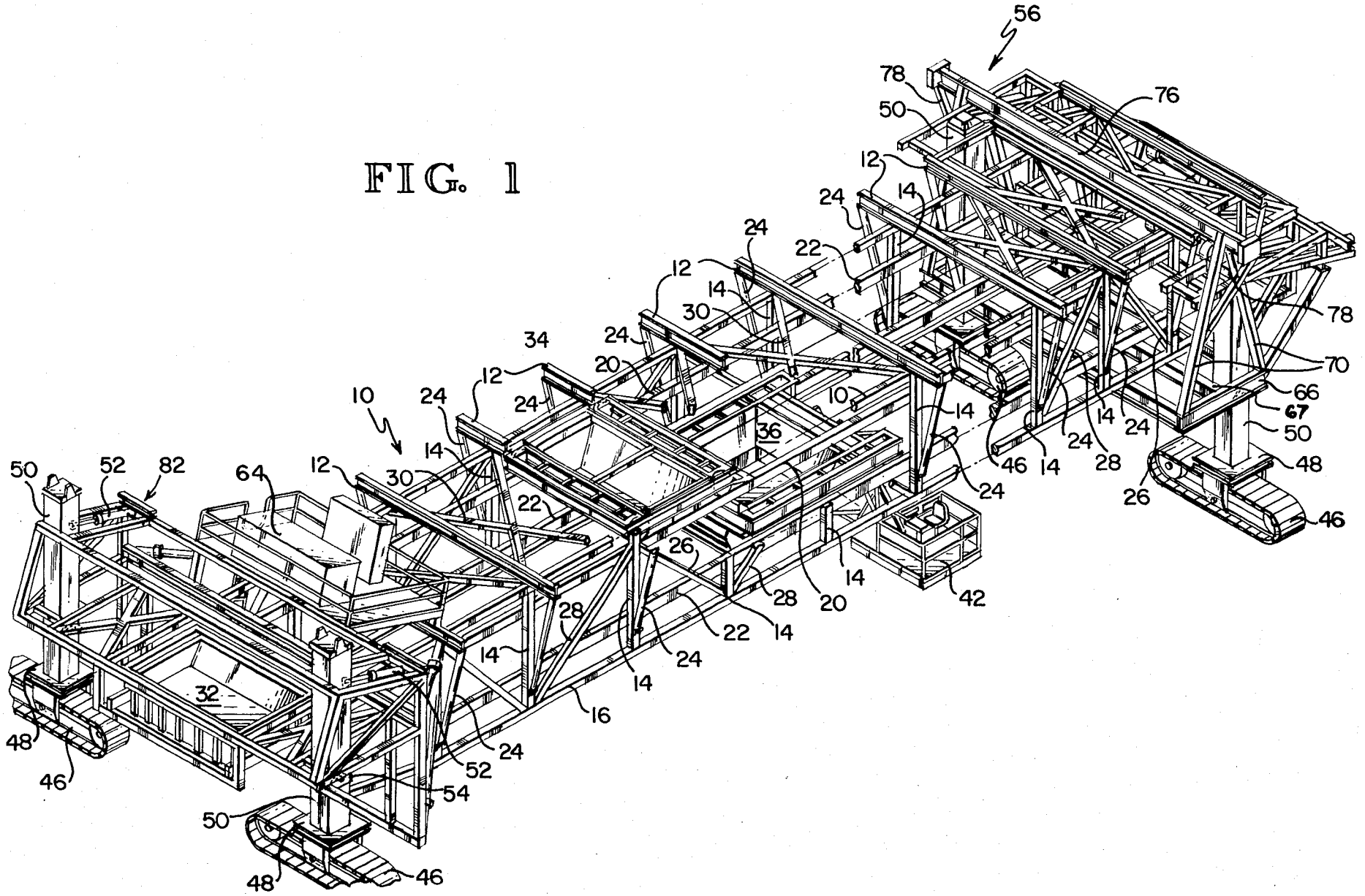
FIG. 1 is an isometric view of a preferred rip-rap laying machine.
Figure 11:
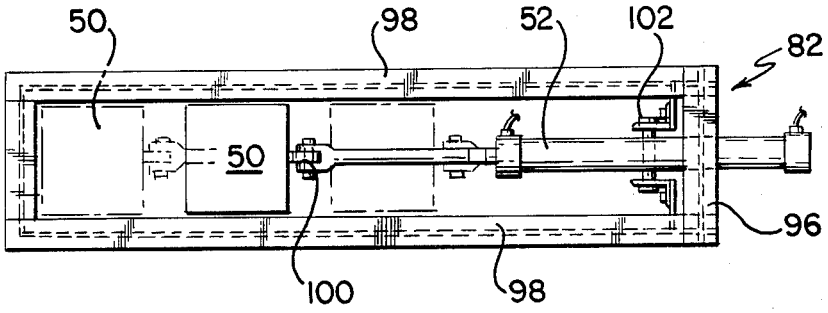
FIG. 11 is a detailed view of a slide frame-mast trunnion.

Four self-propelled crawler tracks 46 having turntables 48 and associated masts 50 are attached to the upper and lower ends of the bridge by suitable means which allow pivoting of the bridge relative to each mast, thereby varying the angle between the respective track 46 and the bridge. Two tracks 46 at the lower end 300 of the bridge are pivotally secured to the bridge frame by pins 54 (see FIGS. 1 and 12); two tracks 46 are pivotally secured to a slide frame 56. The angle of each track relative to the frame is adjusted by extension or retraction of the piston of a hydraulic cylinder 52 which is pivotally secured to the mast 50 of a track 46. Each hydraulic cylinder is mounted in a trunnion frame 82 (FIG. 11). The mast 50 is extensible to allow raising and lowering of the bridge relative to each track 46. The range of angles which the tracks and bridge need assume may vary, but generally ranges between about a 2:1 slope to a 3:1 slope. As previously mentioned, the upper pair of tracks 46 is secured to the slide frame 56 rather than directly to the bridge. While the slide frame 54 will be described in greater detail later, it encircles the bridge, carries the tracks 46, allows raising, lowering, and pivoting of the bridge relative to the tracks 46, and is positionable along the length of the bridge at a plurality of positions to vary the effective length of the rip-rap laying machine by varying the relative distance between the lower pair of tracks 46 secured to the bridge frame and the upper pair of tracks 46 secured to the slide frame 54. If the upper pair of tracks 46 is secured to the bridge, the rip-rap laying machine will not be able to alter its effective length.

A control bridge 64 is mounted on one end of the bridge near the dump hopper 32 to house the power supplies and control means for operating the machine. Preferably, each track 46 has a self-contained power supply. The winches 55 and 58 and other hydraulic and electrical components of the rip-rap laying machine, however, preferably are powered from a hydraulic supply and an electrical generator means on the control bridge 64. The vibratory feeder 38 has a self-contained motor so that it is able to vibrate rip-rap from its trough. A power pack (not shown) on the feeder hopper frame is used to power the deflector plate 44.

Turning to the details of the slide frame 56, reference is made to FIGS. 9, 10A, 10B, and 10C. The slide frame has a generally rectangular base 66 having a longitudinal cross-member 67 (FIG. 1) and transverse cross-members 68 to further strengthen the base 66. Two slide frame tracks 46 (FIG. 1) are connected to associated masts 50, which, in turn, are pivotally mounted to opposite corners of the slide frame 66. As with the lower tracks and masts, the slide-frame masts 50 are extensible to allow raising and lowering of the base 66 relative to the slide-frame tracks 46. Vertical supports 70 on each side of the bridge extend between the base 66 and an upper strut 76 which extends over the top of the bridge. Two supports 70 are placed on each side of the slide frame 56, and each support 70 extends at an acute inside angle with the minor axis 72 of the slide frame 56 while each is substantially perpendicular to the major axis 74 of the slide frame 56. In this way, the two supports 70, the strut 76, and the base 66 form triangular stiffeners on the ends of the base 66. To further reinforce the strut 76, angled cross-members 78 may extend upwardly from the inner cross-member 68 on that side of the base 66 to the end of the strut 76 (as best shown in FIG. 10A).

Additional stability is provided for the slide frame 56 by including projecting legs 80 that extend upwardly from the base 66 to the bottom of the trunnion frame 82. Lateral support arms 84 extend from the trunnion frames 82 and legs 80 across the width of the bridge connect to the opposite rail in the upper pair of rails 20. Generally, four spaced, lateral support arms 84 are used, as shown in FIG. 9.

Beams 86 rest atop the base 66 of the slide frame 56 (FIGS. 10A and 10B) to support the bridge by contacting the lower pair of beams 16. Guide members 88 reduce wobble between the slide frame 56 and bridge, and allow easier guiding of the slide frame 56 relative to the bridge when sliding the slide frame 56 along the bridge. To secure the bridge relative to the slide frame 56, at least two friction clamps 90 on each side of the base 66 are connected about the lower beam 16 of the bridge and the beam 86 of the slide frame 56. Basically, each friction clamp 90 is a modified C-clamp which has two friction-bearing faces held together by threaded rods (as best seen in FIG. 10B).

Shim plates 92 are bolted between a strut 12 of the bridge and the strut 76 of the slide frame 56 (as shown in FIGS. 10A and 10C). When the slide frame 56 is to be repositioned, the shim plates 92 are removed and the slide frame 56 is allowed to drop down so that the roller 94 of guide member 88 (see FIG. 10B) rests on the lower beam 16 of the bridge and rolls on the beam 16 as the slide frame is repositioned. Once repositioned, the slide frame 56 is lifted, the shim plates 92 are reinserted, and the friction clamps 90 are reclamped around the beams.

The slide frame 56 also includes means for pivoting the base 66 relative to the masts 50 and associated tracks 46. A preferred means for pivoting the base includes a trunnion frame 82 (FIGS. 11 and 12) housing a hydraulic cylinder 52. The trunnion frame 82 guides movement of the mast 50 relative to the bridge. Basically, the trunnion frame 82 includes a base member 96 and two projecting arms 98 spaced substantially parallel to one another and connected to the base member 96. Gussets (not shown) may be used at the intersection of the arms 98 and base member 96 to strengthen the trunnion frame 82. The mast 50 fits between the arms 98 and tracks between the arms 98 during the relative movement of the bridge and mast 50. As shown in FIG. 11, the hydraulic cylinder 52 is actuatable to position the mast 50 in at least three positions with respect to the guide arms 98. A hinged coupling 100 between the piston of the hydraulic cylinder 52 and the mast 50 and a pin 102 pivotally mounted to the cylinder 52 between the projecting arms 98 of the trunnion frame 82 allow changes in angle between the mast 50 and trunnion frame 82 as the piston is extended or retracted.

Figure 12:
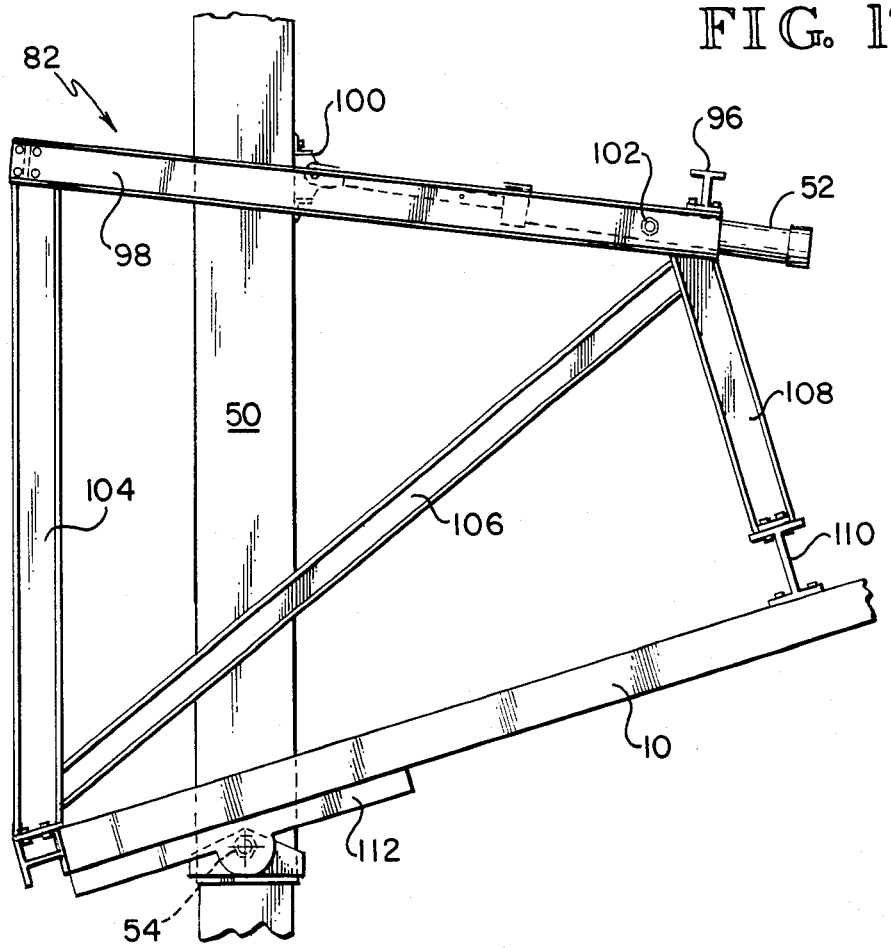
FIG. 12 is a detailed side elevational view of a trunnion which is used to vary the angle between the tracks and bridge.

FIG. 12 shows the trunnion frame 82 mounted to the lower end 300 of the bridge near the dump hopper 32. The trunnion frames 82 that are mounted on the slide frame 56 are analogous. For the lower end 300 of the bridge, the trunnion frame 82 is usually mounted through support members 104, 106, 108, and 110 to the upper beam 10 of the bridge. On the slide frame 56, however, the trunnion frame 82 is connected with suitable members to the base 66. The beam 10 is pivotally connected through pin 54 to the masts 50 with ear members 112. Alternatively, either rail system may be pivotally connected to the masts 50. Thus, when the piston of the hydraulic cylinder 52 is extended to move the piston toward the left in FIG. 12, the trunnion frame 82 and bridge (depicted by beam 10) pivots about the pin 54 in a clockwise direction relative to the fixed mast 50. Similarly, when the piston of hydraulic cylinder 52 is shortened by withdrawing the piston into the hydraulic cylinder 52, the bridge (depicted by beam 10) pivots in a counterclockwise direction. The rip-rap laying machine has four hydraulic cylinders 52 and four trunnion frames 82 to allow adjustment of the bridge relative to each track. Each hydraulic cylinder 52 may operate independently. Because operation of a single cylinder, however, could cause either damage to the cylinder 52 or racking of the bridge, commonly, all four hydraulic cylinders 52 are operated simultaneously to adjust the angle of the bridge relative to the fixed masts 50 and tracks 46. The bridge preferably is multipositionable at several angles relative to the bank, such as slopes of 2:1, 2.5:1, and 3:1, as provided for in a preferred design.

Figure 4:
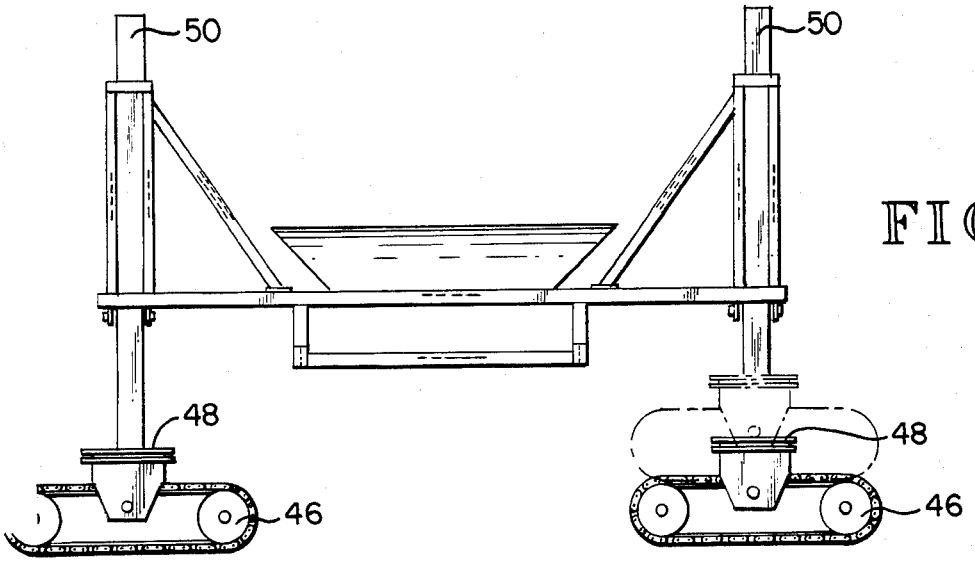
FIG. 4 is a schematic view illustrating raising or lowering of tracks attached to the bridge of the rip-rap laying machine of FIG. 1.
Figure 14:
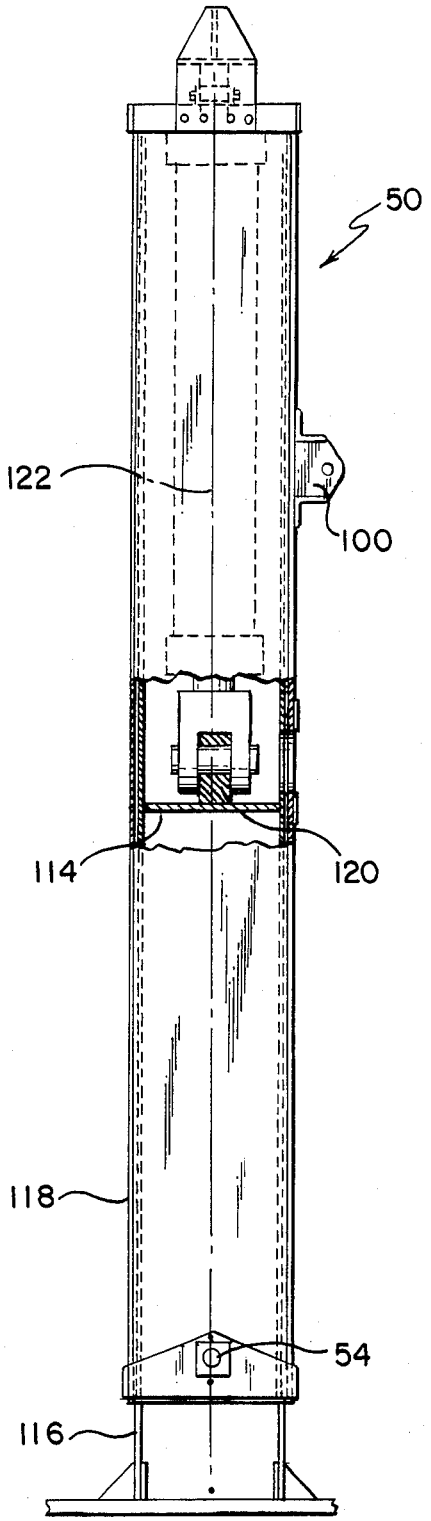
FIG. 14 is a detailed view of a preferred mast for a track of the rip-rap laying machine.

As shown in FIG. 14, each mast 50 includes telescoping columns 116 and 118. The top 114 of the lower, inner column 116 extends into the open end of the outer column 118 and includes a coupling 120 which connects with the piston of a hydraulic cylinder 122 mounted within the upper column 118. The upper column 118 is fixed to the bridge through the trunnion frame 82 and the pin 54, while the inner column 116 is connected to a track 46. Upon extension of the piston of the hydraulic cylinder 122, column 118 slides upwardly, raising the entire bridge relative to the fixed track 46. Alternatively, the track 46 may be lifted off the ground or lowered back to the ground with the hydraulic cylinder 122. As shown schematically in FIG. 4, the relative height of each track may be independently adjusted by the respective hydraulic cylinders 122 included within the telescoping columns 116 and 118 of each mast 50.

The bridge may assume a plurality of angles relative to the bank 40; thus, the feeder hopper 36 preferably is pivotally mounted to its frame 124, which tracks on wheels 126 upon the lower pair of beams 22 (see FIG. 13). The pivot 128 and an adjustable setting member 130 allow repositioning of the feeder hopper 36 relative to the lower beam 22 of the bridge. Being multipositionable allows the feeder hopper 36 to maintain the proper angle for the vibratory feeder 38 relative to the bank 40. As can be best seen in FIG. 13, the vibratory feeder 38 is pivotally connected to the feeder hopper 36 through pivot arms 132 and 134. Pivot arm 132 is attached by an eye 136 to the body of the vibratory feeder 38 and by a pin 138 to the body of the feeder hopper 36. Pivot arm 134 is connected by an eye 140 to the body of the vibratory feeder 38 and includes a cable 142 to connect its upper end (not shown) to the frame 124 of the feeder hopper 36. The vibratory feeder 38 is a Syntron, Model MF-600-C, electromechanical vibratory feeder available from the FMC Corporation including a carbon steel, flat-bottom, diagonal discharge trough that is 72 inches wide by 108 inches long on the left side, and 149½ inches long on the right side. The trough bottom and sides are equipped with replaceable, ½-inch thick, abrasion-resistant steel liners. The vibratory feeder 38 is driven by a below-deck drive unit able to maintain an output of 15 horsepower and is arranged for suspension mounting at a recommended down-slope angle of ½ degree in the direction of material discharge. The feeder 38 includes a separate solid-state motor, Model MC-3, variable-voltage control, and is driven from a 460-volt, 3-phase, 60-cycle power source which is mounted on the control bridge 64.

A deflector plate 44, positioned just beyond and below the discharge trough of the vibratory feeder 38, can assume a variety of angles relative to the bank 40. A beam 144 projects below the frame 124 of the feeder hopper 36 and is rigidly affixed to the frame 124 through suitable cross-members 146 and 148. A hydraulic cylinder 150 atop the beam 144 allows adjustment of a dog 152 pivotally connected with pin 154 to connecting arm 156. The connecting arm 156 is pivotally connected to the deflector plate 44 through a pin 158 and a coupling 160. The connecting arm 156 also includes a second hydraulic cylinder 162 mounted through a coupling 164 intermediate the length of the connecting arm 156. The other end of the hydraulic cylinder 162 is connected with a coupling 166 to the upper end of the deflector plate 44. An electrical power pack (not shown) on the feeder hopper frame drives the hydraulic cylinders. Thus, as shown in FIG. 13, operation of the hydraulic cylinders 150 and 162 allows variation of the relative angle of the deflector plate 44 with respect to the vibratory feeder 38 and bank 40. An operator sitting on the operator's platform 42 cantilevered outwardly from the frame 124 of the feeder hopper 36 operates the deflector plate 44 and vibratory feeder 38 to ensure uniform placement of rip-rap from bottom to top along the bank 40. The operator rides with the feeder hopper 36 and controls the loading hopper 34 to load rip-rap from the dump hopper 32 and to carry the rip-rap to the feeder hopper 36. Rip-rap falls from vibratory feeder 38 onto the deflector plate 44 before rolling gently onto sheets of filter cloth (not shown) placed upon the bank 40.

II. Operation of the Rip-Rap Laying Machine

Although the operation of raising or lowering the masts 50 relative to the tracks 46 has been explained previously, it is probably beneficial to rediscuss that operation along with the other operations fundamental to operation of the rip-rap laying machine of this invention. Each mast 50 comprises an inner column 116 and outer column 118 which telescope with respect to one another. A hydraulic cylinder 122 contained within column 118 is extensible to push against the top 114 of column 116 and to lift the bridge upwardly relative to a fixed track 46 on the ground. The outer column 118 is pivotally attached to the bridge to allow its raising and lowering. Extending the piston of the hydraulic cylinder 122 forces the bridge to rise above the track 46 because the column 118 is raised relative to the top 114 of the inner column 116. In most circumstances, the tracks 46 on either end of the bridge will be positioned at the same height, but, in special circumstances, it is possible that the tracks assume different heights.

Figure 5:
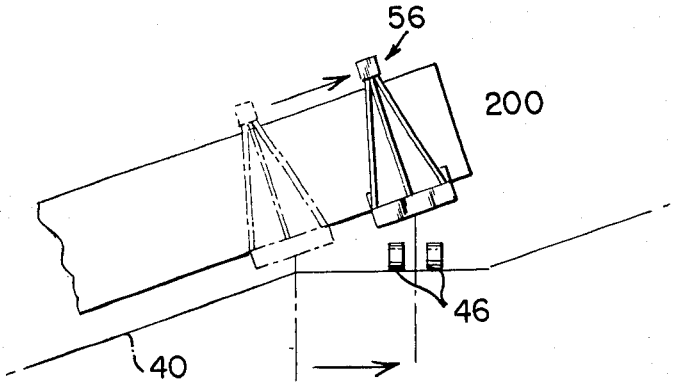
FIG. 5 is a schematic view illustrating adjustment of the slide frame of the rip-rap laying machine of FIG. 1.
Figure 6:
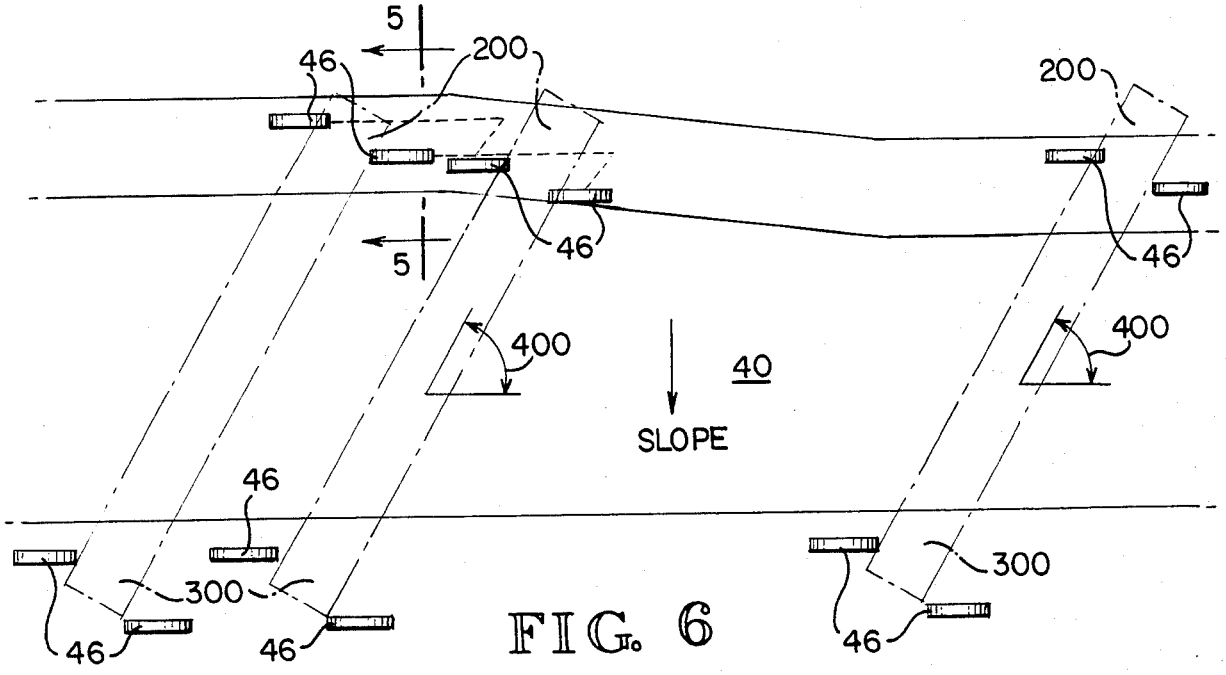
FIG. 6 is a schematic plan view illustrating adjusting of the position of the slide frame.

As schematically illustrated in FIGS. 5 and 6, the upper end 200 of the rip-rap laying machine generally trails the leading, lower end 300 of the machine when rip-rap is being laid, and the machine travels at an angle 400 with respect to the bank 40. If the bank 40 becomes wider, the slide frame 56 must be moved to extend the effective length of the bridge so that the desired angle of travel 400 may be maintained. To move the slide frame 56, the upper end 200 of the bridge is blocked so that the slide frame tracks 52 can be raised off the ground to allow the slide frame to be moved to the desired, new position by sliding the slide frame 56 along the bridge. Preferably, the hydraulic cylinders 122 within the masts 50 of the tracks 46 on the slide frame 56 are extended to their fully extended position so that the maximum height between the bank 40 and bridge is obtained prior to moving the slide frame 56. Pigtail chokers (not shown) are clamped onto the feeder hopper cables 62 and are connected to the slide frame 56. The friction clamps 90 are unbolted and the lateral support members 84 and shim plates 92 are removed. Upon removal of the shim plates 92, the slide frame 56 is able to drop down so that roller bearings 94 contact the lower beam 16 of the bridge, thereby allowing the slide frame 56 to be rolled to its new position. The hydraulic cylinders 122 within the masts 50 of the slide frame tracks 46 are retracted to raise the tracks 46 off the ground. Once the tracks 46 clear the ground, the feeder hopper winch 55 can be used to move the slide frame 56 to its new position by moving the feeder hopper cables 62 and associated pigtail chokers. Then, the tracks 46 of the slide frame 56 are lowered to recontact the ground and to lift the bridge slightly. The shim plates 92 are reinserted, lateral support members 84 are replaced, and friction clamps 90 are repositioned. When properly bolted and supported, the tracks 46 can be lowered to take the weight of the bridge off the blocks, and the blocks can be removed. If, during the adjustment of the slide frame's position on the bridge, the angle of the slope has changed, the feeder hopper 36 should be readjusted to the proper slope by repositioning the pin connection on the adjustable setting member 130 of the feeder hopper 36.

Figure 7:
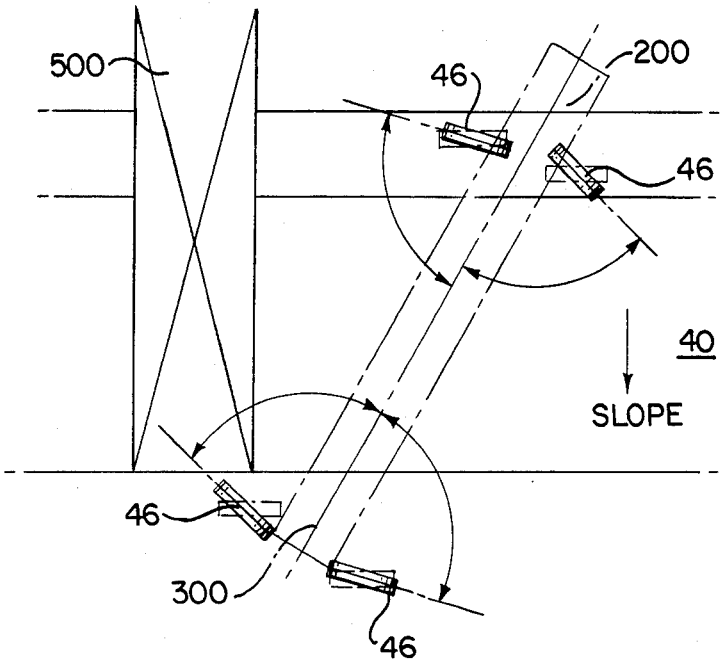
FIGS. 7 and 8 are schematic views illustrating how the rip-rap laying machine can be moved to avoid obstacles.
Figure 8:
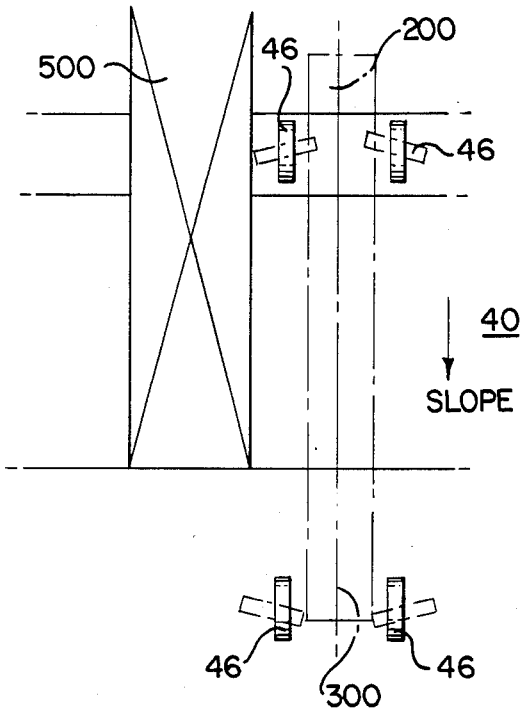

The ability of the rip-rap laying machine to avoid obstacles in its course is illustrated schematically in FIGS. 7 and 8. First, the deflector plate 44 is raised to avoid contact with the bank 40. Both ends 200 and 300 of the rip-rap laying machine are raised with the hydraulic cylinders 122 of the masts 50 as high as possible and the bridge is supported on blocks above the bank 40. After blocking, the tracks 46 are lifted off the ground. The lower tracks 46 are rotated 75.75 degrees from the centerline of the rip-rap laying machine bridge using the track steering cylinders (not shown) and turntables 48 incorporated into each track. Similarly, the upper tracks are rotated 77.25 degrees from the centerline of the machine. All the tracks are then lowered back to the ground to support the weight of the rip-rap laying machine and to allow removal of the blocking. The tracks are simultaneously propelled to get the machine back in line with the slope rather than to run at the original operating angle 400. When in line, the tracks are raised again and the bridge is supported on blocks. Once again, the tracks 46 are raised from the ground by retraction of the pistons of cylinders 122 and are rotated to extend parallel to the centerline of the bridge of the rip-rap laying machine. Then the tracks 46 are relowered to support the bridge, and the blocking is removed. The machine may then be walked down the slope. As the machine begins to come down the slope, however, the angle of the bridge relative to the tracks 46 must be constantly adjusted because the slope will change steadily. All four hydraulic cylinders 52 must be used to maintain a constant relationship between the bridge and the bank slopes. To walk up the slope, the steps are reversed.

This sequence of steps for avoiding obstacles may also be modified, as will be understood by those skilled in the art, to rotate the rip-rap laying machine 180 degrees and to reposition the rip-rap laying machine relative to the opposite bank of the channel at the proper operating angle.

Preferably, the controls for the loading hopper 34 allow it to be sent to the lower end of the rip-rap laying machine, where it automatically stops and stays until the operator calls for the loading hopper 34 to return to the feeder hopper 36. Upon return to the feeder hopper 36, the loading hopper 34 automatically stops and follows the feeder hopper 36 until the operator sends it back to the lower end 300 of the bridge for refilling at the dump hopper 32. The feeder hopper 36 delivers the rip-rap to the vibratory feeder 38, which, in turn, spreads the rip-rap uniformly along the bank. Although generally described in this concluding paragraph to the detailed description of the invention, the method of laying rip-rap is understandable with reference to the detailed description of the structure and function of the rip-rap laying machine.

I claim:

1. A rip-rap laying machine capable of distributing rip-rap on an acutely angled bank, comprising:

(a) a bridge defining a main structure for the machine;

(b) a plurality of tracks pivotally secured to the bridge through a mast, the tracks allowing movement of the bridge, each track including a mast which is:

(i) extensible to allow raising and lowering of the bridge relative to each track, and (ii) pivotable relative to the bridge to allow the bridge to assume a plurality of angles relative to each track and to the bank;

(c) means attached to the bridge for pivoting the bridge relative to each mast to vary the angle between the respective track and the bridge;

(d) a dump hopper secured to the bridge to receive rip-rap;

(e) an upper pair of rails secured to the bridge and extending along substantially the entire length of the bridge;

(f) a lower pair of rails secured to the bridge and extending along substantially the entire length of the bridge substantialy parallel with the upper pair of rails;

(g) a loading hopper for moving along the bridge along the upper pair of rails, for receiving rip-rap from the dump hopper, and for transporting and discharging the rip-rap to a rip-rap laying means; and (h) a rip-rap laying means for moving along the bridge along the lower pair of rails, for receiving rip-rap from the loading hopper at any point along the length of the bridge, and for distributing the rip-rap along the bank.

2. The rip-rap laying machine of claim 1 wherein the rip-rap laying means includes:

(a) a feeder hopper moving along the bridge along the lower pair of rails for receiving rip-rap from the loading hopper; and (b) a vibratory feeder disposed beneath the feeder hopper for receiving rip-rap from the feeder hopper and for distributing the rip-rap on the bank.

3. The rip-rap laying machine of claims 1 or 2, further comprising a deflector plate operatively associated with the rip-rap laying means to deflect rip-rap discharged from the rip-rap laying means and to cushion distribution of the rip-rap onto the bank.

4. The rip-rap laying machine of claim 3 wherein the deflector plate includes means to vary the angle of the plate relative to the bridge, to vary, accordingly, the distribution effect that the plate has on the laying of rip-rap.

5. The rip-rap laying machine of claim 1, further comprising a slide frame for varying the distance between the tracks along the length of the bridge, the slide frame spanning across the width of the bridge to encircle the bridge, carrying at least one track with an associated mast for that track, and being mulipositionable along the length of the bridge to vary the effective length of the machine by varying the relative distance between the tracks.

6. The rip-rap laying machine of claims 1 or 5, further including an operator's control platform cantilevered outwardly from the rip-rap laying means enabling at least one operator to supervise and to control the laying of rip-rap by riding along with the rip-rap laying means on the control platform.

7. The rip-rap laying machine of claims 1 or 5 wherein each track includes a turntable to allow free rotation of the track relative to the bridge.

8. The rip-rap laying machine of claims 1 or 5 wherein each track includes drive means which are independently operable apart from the other tracks.

9. The rip-rap laying machine of claims 1 or 5 wherein the loading hopper is moved along the length of the bridge by means of a first cable and winch system, wherein the winch is mounted on the bridge and the cable is wound around the winch and is connected to the loading hopper, and wherein the rip-rap laying means is moved along the length of the bridge by means of a second cable and winch system, wherein the winch is mounted on the bridge and the cable is wound around the winch and is connected to the rip-rap laying means.

10. The rip-rap laying machine of claim 2 wherein the feeder hopper is positionable at a plurality of angles relative to the bridge to allow distribution of rip-rap at the plurality of angles which the rip-rap laying machine assumes.

11. The rip-rap laying machine of claims 1 or 5 wherein the bridge comprises a generally U-shaped truss opening downwardly, comprising:

(a) an upper pair of beams extending substantially parallel to each other and defining a length for the bridge;

(b) a plurality of spaced, substantially parallel struts extending across the beams substantially perpendicular to the beams, attached to the beams, and defining a width for the bridge;

(c) a plurality of supports extending downwardly from the struts, one support attached near each end of each strut, and defining a depth for the bridge and a width for the rail systems;

(d) a lower pair of beams attached substantially to the bottom of the supports on each side of the bridge extending substantially along the entire length of the bridge substantially parallel to the upper pair of beams;

(e) means attached to the supports to hold the upper and lower pairs of rails in spaced relationship to each other;

(f) angled reinforcing members at each support extending between each support and each associated strut outside the width for the rail systems to strengthen the bridge;

(g) for each series of three supports on either side of the bridge;

(i) a first cross-member extending between the upper and lower beams between a first and second support of the series, and (ii) a second cross-member extending between the lower and upper beams diagonally transverse to the first cross-member and extending between the second and third support of the series, wherein the third support of a first series of three supports becomes the first support of a second series; and (h) pairs of strut-reinforcing means crossing between adjacent pairs of struts and extending between the supports in a plane substantially parallel to a plane defined by the upper pairs of beams.

12. A rip-rap laying machine capable of distributing rip-rap on an acutely angled bank, comprising:

(a) a bridge defining a main structure for the machine and having a length and a width;

(b) two spaced crawler tracks pivotally secured to one end of the bridge for moving the bridge, each track including a mast that is extensible to raise and lower the bridge relative to each track and that is pivotably secured to the bridge to allow the bridge to assume a plurality of angles relative to the track;

(c) means, secured to the bridge, for pivoting the bridge relative to the masts and tracks;

(d) a dump hopper secured to the bridge to receive rip-rap;

(e) an upper pair of rails extending along substantially the entire length of the bridge;

(f) a lower pair of rails extending along substantially the entire length of the bridge substantially parallel to the upper pair of rails;

(g) a loading hopper for moving along the bridge along the upper pair of rails, for receiving rip-rap from the dump hopper, and for transporting the rip-rap to a rip-rap laying means;

(h) a rip-rap laying means for moving along the bridge along the lower pair of rails, for receiving rip-rap from the loading hopper at any point during travel along the bridge, and for distributing the rip-rap along the bank; and (i) a slide frame for varying the effective length of the rip-rap laying machine, having—

(i) a base;

(ii) two slide frame tracks for supporting the slide frame and bridge on the ground;

(iii) a pivotable and extensible slide-frame mast associated with each track, pivotally secured to the slide frame, and allowing—

(A) raising and lowering of the slide frame relative to the track, and (B) pivoting of the slide frame relative to the track, wherein the masts are pivotally secured to opposite corners of the base; and (iv) means for pivoting the base relative to the masts and associated tracks;

wherein the slide frame is positionable along the length of the bridge at a plurality of positions to vary the effective length of the rip-rap laying machine by varying the relative distance between the tracks on the bridge and the tracks on the slide frame.

13. The rip-rap laying machine of claim 12 wherein the rip-rap laying means includes:

(a) a feeder hopper for moving along the bridge along the lower pair of rails, for receiving rip-rap from the loading hopper, and for transferring the rip-rap to a vibratory feeder; and (b) a vibratory feeder disposed beneath the feeder hopper for receiving rip-rap from the feeder hopper and for distributing the rip-rap on the bank.

14. The rip-rap laying machine of claim 12 or 13 wherein, on the slide frame, the means for pivoting the base relative to the masts of the slide frame includes, for each mast:

(a) a hinge coupling attached to each mast, (b) a piston of a hydraulic cylinder secured to the hinge, (c) means for operating the hydraulic cylinder to extend or to retract the piston of the cylinder, and (d) means for pivotally attaching the hydraulic cylinder to the base.

15. The rip-rap laying machine of claim 12 or 13 wherein the means for pivotally connecting each mast on the end of the bridge to the bridge includes:

(a) a hinge coupling on each mast, (b) a piston of a hydraulic cylinder secured to the coupling, (c) means for operating each hydraulic cylinder to extend or to retract the piston of the cylinder, and (d) means for pivotally attaching the hydraulic cylinder to the bridge.

16. A method of laying rip-rap on an acutely angled bank, comprising the steps of:

(a) placing a bridge of a rip-rap laying machine across the bank to overlie the bank;

(b) loading rip-rap into a dump hopper on the bridge;

(c) filling a loading hopper from the dump hopper;

(d) transporting the loading hopper along the bridge structure to a feeder hopper;

(e) transferring rip-rap from the loading hopper to the feeder hopper;

(f) cascading the rip-rap from a mouth of the feeder hopper; and (g) interrupting the falling cascade of rip-rap exiting the feeder hopper's mouth with a deflector plate, positioned below the mouth, to cushion the distribution of and to vary the distribution of the rip-rap on the bank.

17. A rip-rap laying machine capable of distributing rip-rap on an acutely angled bank, comprising:

(a) a bridge defining a main structure for the machine;

(b) a plurality of tracks, mounted on the bridge, at least one track fixed at one end of the bridge and at least one other track being positionable at a plurality of positions along the bridge;

(c) means for varying the angle of the bridge relative to the fixed track;

(d) rip-rap receiving means mounted on the bridge;

(e) movable rip-rap laying means capable of moving along the bridge and receiving rip-rap from the rip-rap receiving means, the rip-rap laying means cascading the rip-rap onto the bank through a mouth; and (f) a deflector plate assembly below the mouth of the rip-rap laying means to intercept the cascading rip-rap to cushion its distribution on the bank.

18. The rip-rap laying machine of claim 17 wherein the rip-rap receiving means includes (1) a fixed hopper at the end of the bridge having the fixed track and (2) a movable shuttle hopper capable of shuttling rip-rap from the fixed hopper to the rip-rap laying means.

19. The rip-rap laying machine of claim 18 wherein the rip-rap laying means includes a storage hopper for receiving rip-rap from the shuttle hopper and a vibratory feeder for cascading rip-rap from the storage hopper onto the bank.

20. The method of claim 16 further comprising the steps of:

(a) shuttling the loading hopper back to the dump hopper while cascading the rip-rap from the feeder hopper;

(b) refilling the loading hopper from the dump hopper; and (c) returning the loading hopper to the feeder hopper with additional rip-rap.

* * * * *